US007914297B2

(12) United States Patent
Ikeda

(10) Patent No.: US 7,914,297 B2
(45) **Date of Patent: *Mar. 29, 2011**

(54) ELECTRIC CONNECTION BOX

(75) Inventor: Naoyuki Ikeda, Kosai (JP)

(73) Assignee: Yazaki Corporation, Tokyo (JP)

( * ) Notice: Subject to any disclaimer, the term of this patent is extended or adjusted under 35 U.S.C. 154(b) by 245 days.

This patent is subject to a terminal disclaimer.

(21) Appl. No.: 12/233,654

(22) Filed: Sep. 19, 2008

(65) Prior Publication Data

US 2009/0098747 A1 Apr. 16, 2009

(30) Foreign Application Priority Data

Oct. 11, 2007 (JP) ..... 2007-265476

(51) Int. Cl.
*H01R 12/00* (2006.01)

(52) U.S. Cl. ..... 439/76.1

(58) Field of Classification Search ..... 439/76.1, 439/76.2, 79, 66, 620.01; 361/775; 174/255; 29/846

See application file for complete search history.

(56) References Cited

U.S. PATENT DOCUMENTS

| | | | | |
|---|---|---|---|---|
| 6,848,943 | B2 * | 2/2005 | Machado et al. | 439/607.01 |
| 7,736,157 | B2 * | 6/2010 | Ikeda | 439/76.1 |
| 2001/0012708 | A1 | 8/2001 | Mizuno et al. | |
| 2005/0263320 | A1 * | 12/2005 | Igarashi et al. | 174/255 |

FOREIGN PATENT DOCUMENTS

JP 2001-211529 A 8/2001

* cited by examiner

*Primary Examiner* — Edwin A. Leon
(74) *Attorney, Agent, or Firm* — Sughrue Mion, PLLC

(57) ABSTRACT

An electric connection box include a power supply lead frame, a plurality of external connection terminals, a housing member having connector housing portions formed integrally at its outer peripheral portion and also having the lead frame and the external connection terminals insert molded therein, a plurality of transistors surface mounted in a bare chip condition on an upper surface of the lead frame, a circuit board mounted within the housing member, and bonding wires connecting the transistors, the external connection terminals and the circuit board to each other.

9 Claims, 7 Drawing Sheets

ELECTRIC CONNECTION BOX

BACKGROUND OF THE INVENTION

This invention relates to an electric connection box (i.e., an electric junction block) used as an electric power distribution device (such for example as a relay box, a fuse box, an electronic control unit box, etc.) electrically connected to a battery and various electric loads on a vehicle such as an automobile, and more particularly to an electric connection box which is suitably used for selectively supplying electric power to the electric loads by controlling an on-off control of transistors provided in corresponding relation to the electric loads.

Generally, the supply of electric power to electric loads on a vehicle has heretofore been controlled via electromagnetic relays (i.e., mechanical relays) and fuses. The electromagnetic relays and the fuses are received within a box body of an electric connection box. In the electric connection box to be actually mounted on the vehicle, a plurality of relays, as well as a plurality of fuses, corresponding in number to the electric loads are accommodated within the box body. FIG. 8 is a perspective view showing a conventional electric connection box 300 of the mechanical relay type.

In this electric connection box 300, various connectors 311 are provided at a side face portion of a box body 310, and circuit boards 350 each having electric parts (i.e., relays, etc.) are mounted respectively on upper and lower sides of the box body 310.

In recent years, in order to achieve a compact and lightweight design of an electric connection box and a high-speed switching control, transistors such as power MOSFETs have been increasingly used instead of electromagnetic relays, and electric connection boxes employing transistors have now been described in Patent Literature (see, for example, Patent Literature JP-A-2001-211529).

An electric connection box disclosed in the above Patent Literature 1 includes a bus bar board in which bus bars made of a metal sheet are mounted at least on a surface of an insulating board to thereby form a bus bar circuit, and this bus bar board is accommodated within an insulating case. This electric connection box further includes switch elements each having a plurality of external terminals, and the switch elements are mounted on the surface of the bus bars of the bus bar board, and are incorporated in the bus bar circuit via the external terminals. Further, a printed circuit is formed integrally on part of the surface of the bus bar board, and at least part of the external terminals of the switch element is connected to this printed circuit. In this case, the switch element has the external terminal on its mounting surface, and this external terminal is directly connected to the bus bar. Also, at least part of the external terminals of the switch element are connected to the bus bar via wires.

When transistors are used instead of electromagnetic relays, a thin design and a compact and lightweight design of an electric connection box can be achieved. However, in the conventional electric connection box of Patent Literature 1, particularly measures to achieve a sufficiently-thin design were not taken, and it was difficult to fully meet the requirement of such a thin design.

SUMMARY OF THE INVENTION

This invention has been made in view of the above circumstances, and an object of the invention is to provide an electric connection box in which a thin design and a compact and lightweight design can be further enhanced, and also a heat radiating performance can be enhanced.

The above object has been achieved by an electric connection box of the present invention having features recited in the following Paragraphs (1) to (9).

(1) An electric connection box comprising:
- a metal lead frame to which a power is supplied;
- an external connection terminal having a wire connector portion;
- a circuit board separately provided from the lead frame and separated from the lead frame;
- a transistor mounted on the lead frame;
- a first bonding wire connecting the transistor and the wire connector portion; and
- a second bonding wire connecting the transistor and the circuit board;
- a housing member accommodating the lead frame, the external connection terminal, and the circuit board.

(2) The electric connection box according to the Paragraph (1),
- wherein the wire connector portion of the external connection terminal is arranged in a floating island fashion between the lead frame and the circuit board.

(3) The electric connection box according to the Paragraph (1),
- wherein the housing member is molded of an insulative synthetic resin.

(4) The electric connection box according to the Paragraph (1),
- wherein the transistor is mounted on the lead frame in bare chip condition.

(5) The electric connection box according to the Paragraph (1),
- further comprising a third bonding wire connecting the transistor and the circuit board for monitoring the output voltage of the transistor.

(6) The electric connection box according to the Paragraph (1),
- wherein the external connection terminal and the lead frame are insert molded in the housing member.

(7) The electric connection box according to the Paragraph (1),
- wherein the lead frame is flat plate shaped.

(8) The electric connection box according to the Paragraph (1),
- wherein the wire connector portion is directed perpendicular to a surface of the circuit board.

(9) The electric connection box according to the Paragraph (1),
- wherein the external connection terminals further having a connector terminal portion which is arranged on a periphery of the housing member.

In the electric connection box of the above Paragraph (1), (3), (4), (6), (7) and (9), any circuit pattern for power supply purposes is eliminated from the circuit board, and power supply is entirely controlled via the lead frame provided separately from the circuit board. Therefore, only the circuit pattern for signals need to be formed on the circuit board, and a compact and lightweight design of the circuit board can be achieved. In addition, cross-sectional dimensions of the lead frame are not so limited as compared with circuit patterns formed on the circuit board, and can be freely determined, and therefore a heat radiation performance against heat generated by energization can be enhanced. Furthermore, heat generated at the transistors in the bare chip condition is radiated directly via the lead frame without being transferred to the circuit board, and therefore the excellent heat radiation performance can be obtained. Furthermore, the transistors are used instead of mechanical relays, and besides connectors for power inputting purposes and for electric load-connecting purposes are provided at the outer peripheral portion of the electric connection box, and further the circuit board is provided in the space within the housing member. Therefore, particularly the thin design of the electric connection box can be achieved. Furthermore, the housing member is molded such that not only the external connection terminals but also the lead frame are insert molded in the housing member body, and therefore the lead frame does not need to be mounted on the housing member at a later stage, so that the efficiency of the assembling operation is enhanced.

In the electric connection box of the above Paragraph (2) and (8), the bonding operation for connecting the transistors, the external connection terminals and the circuit board to each other can be carried out easily. Furthermore, the distance between the lead frame and the circuit board increases, and therefore heat is less liable to be transferred from the lead frame to the circuit board, and besides a space is formed between the lead frame and the circuit board, so that the heat radiating performance of the lead frame is enhanced.

In the electric connection box of the above Paragraph (5), the voltage of the output terminal pad portion of the transistor is monitored, and therefore when eddy current develops, a control for turning off the transistor can be possible, thus achieving the function of a fuse.

In the present invention, the thin design and compact and lightweight design of the electric connection box can be achieved, and also the heat radiation performance can be enhanced.

The present invention has been briefly described above. Details of the invention will become more manifest upon reading the following Section "Best Mode for Carrying Out the Invention" with reference to the accompanying drawings.

DESCRIPTION OF PREFERRED EMBODIMENTS

A preferred embodiment of the present invention will now be described in detail with reference to the drawings.

Figure 1:
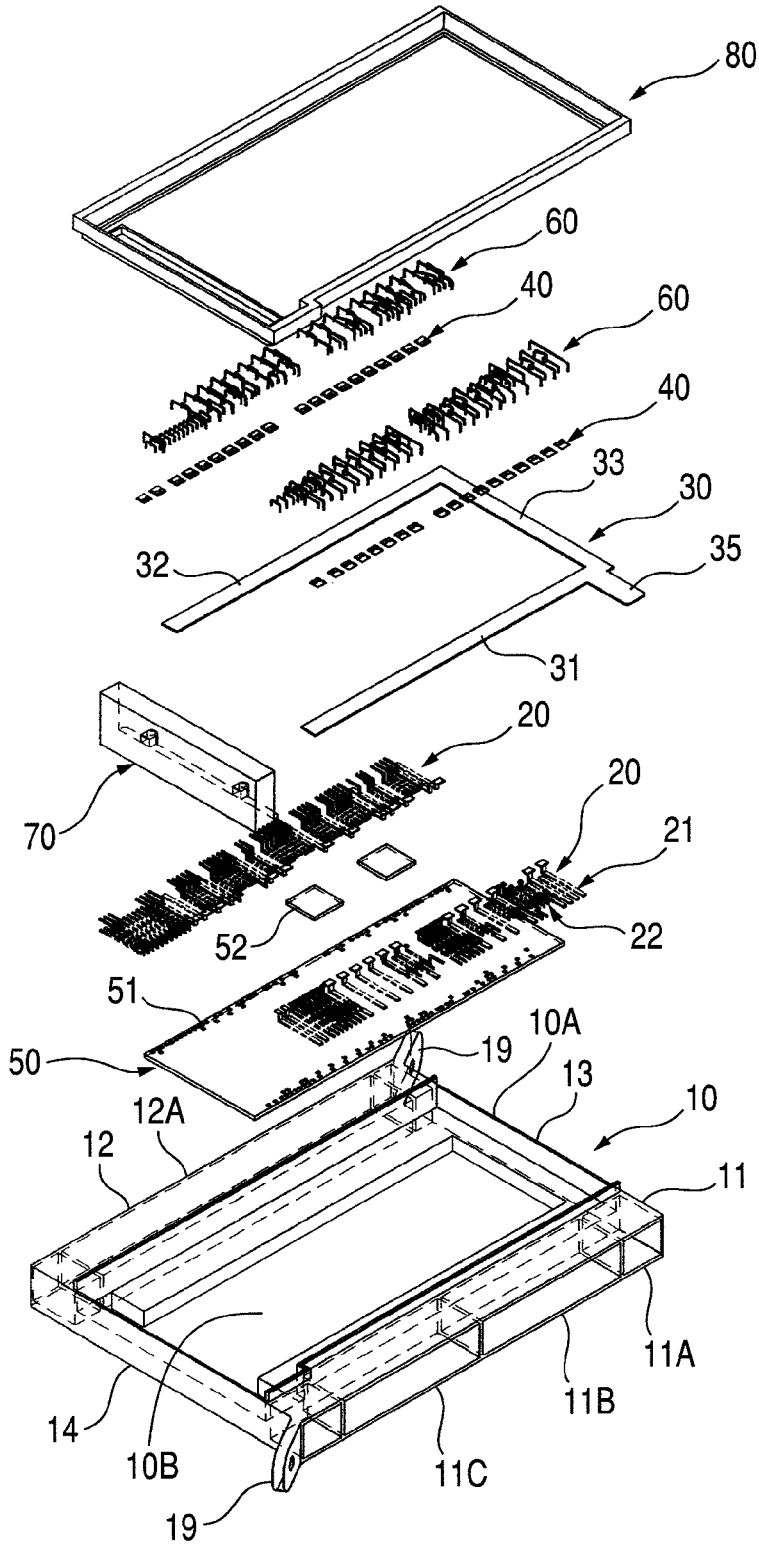
FIG. 1 is an exploded perspective view of one preferred embodiment of an electric connection box of the present invention.
Figure 2:
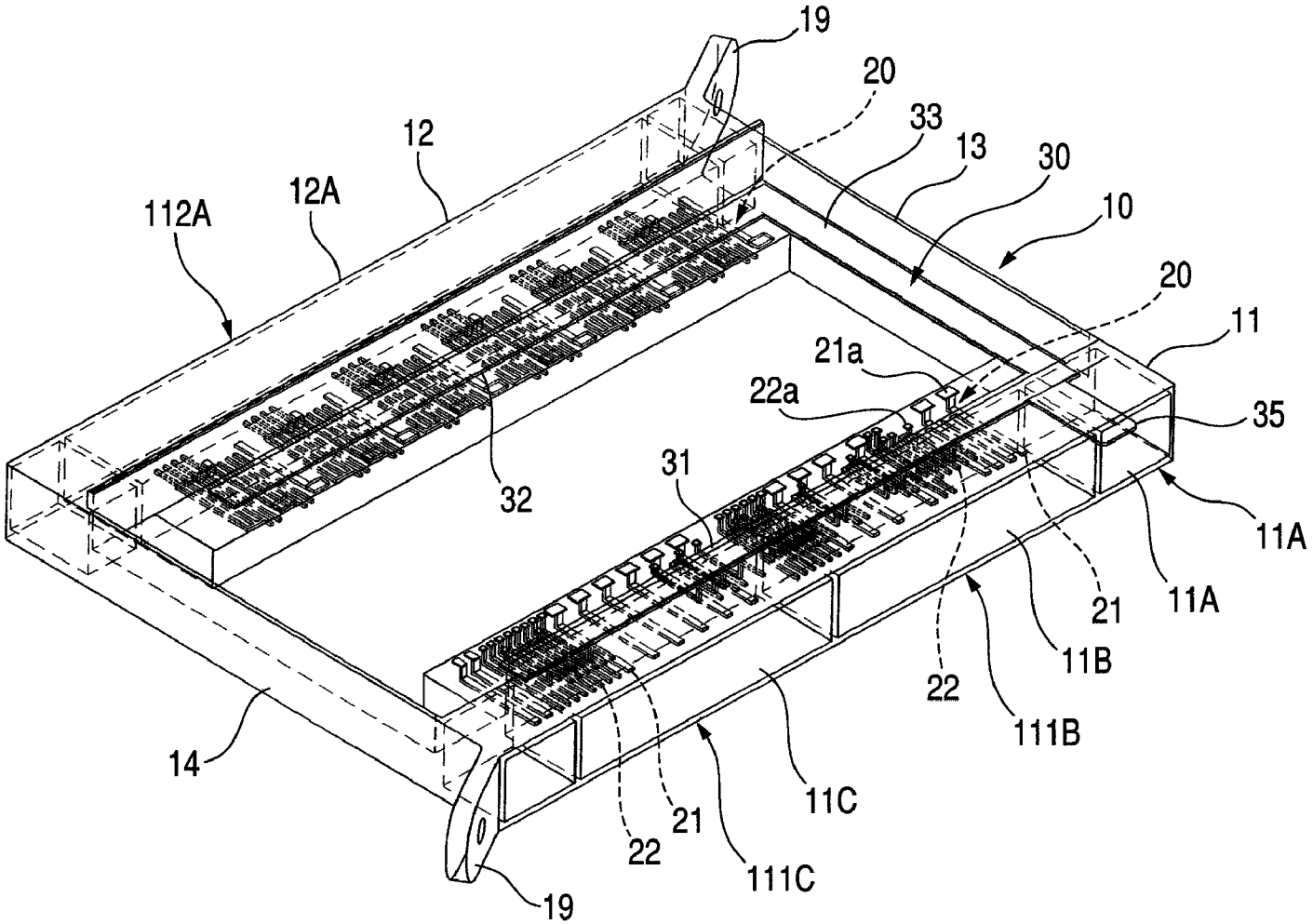
FIG. 2 is a perspective view of a housing member of the electric connection box having external connection terminals and a lead frame which are provided integrally therewith.
Figure 3:
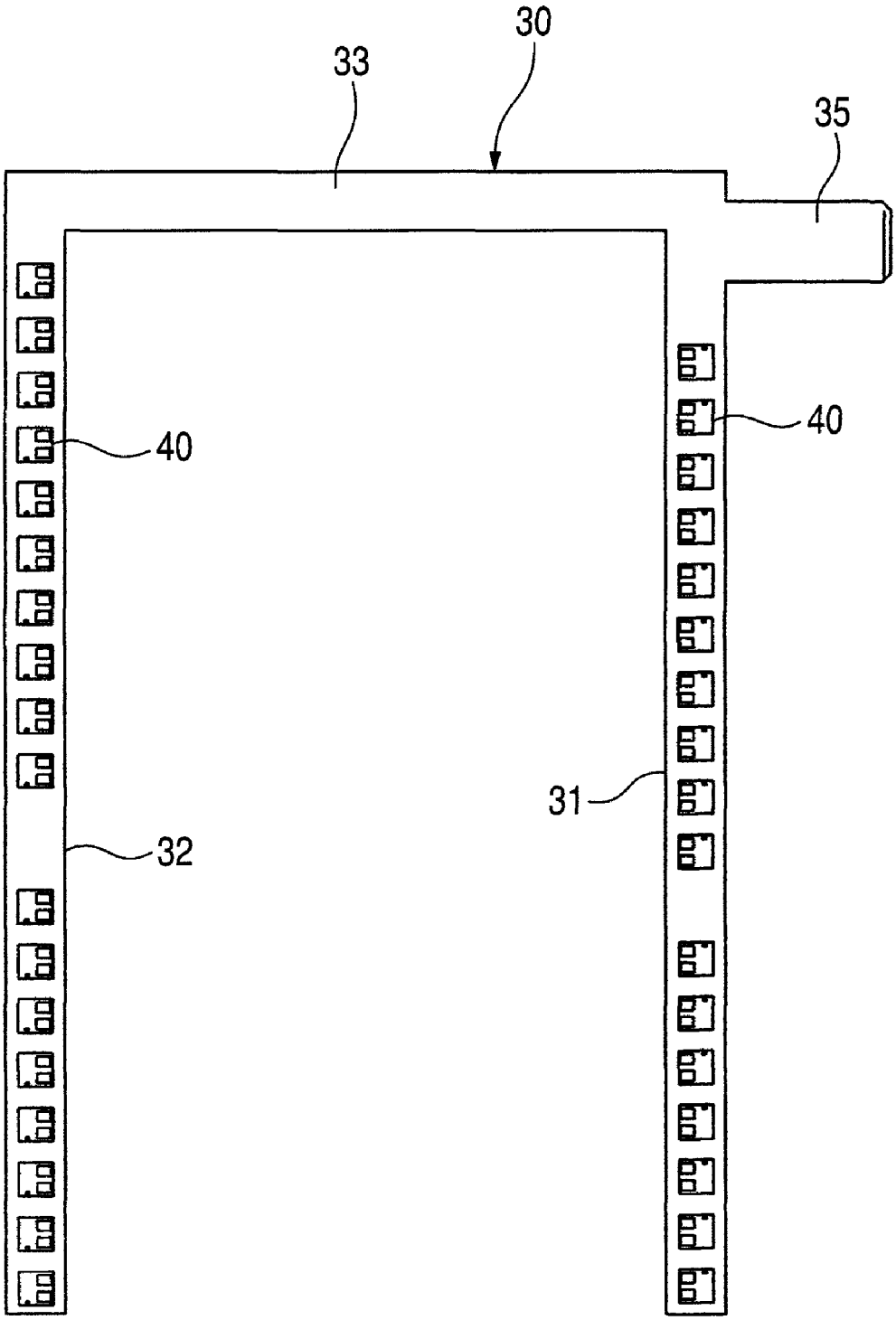
FIG. 3 is a plan view of the lead frame on which transistors each in a bare chip condition are surface mounted.
Figure 4:
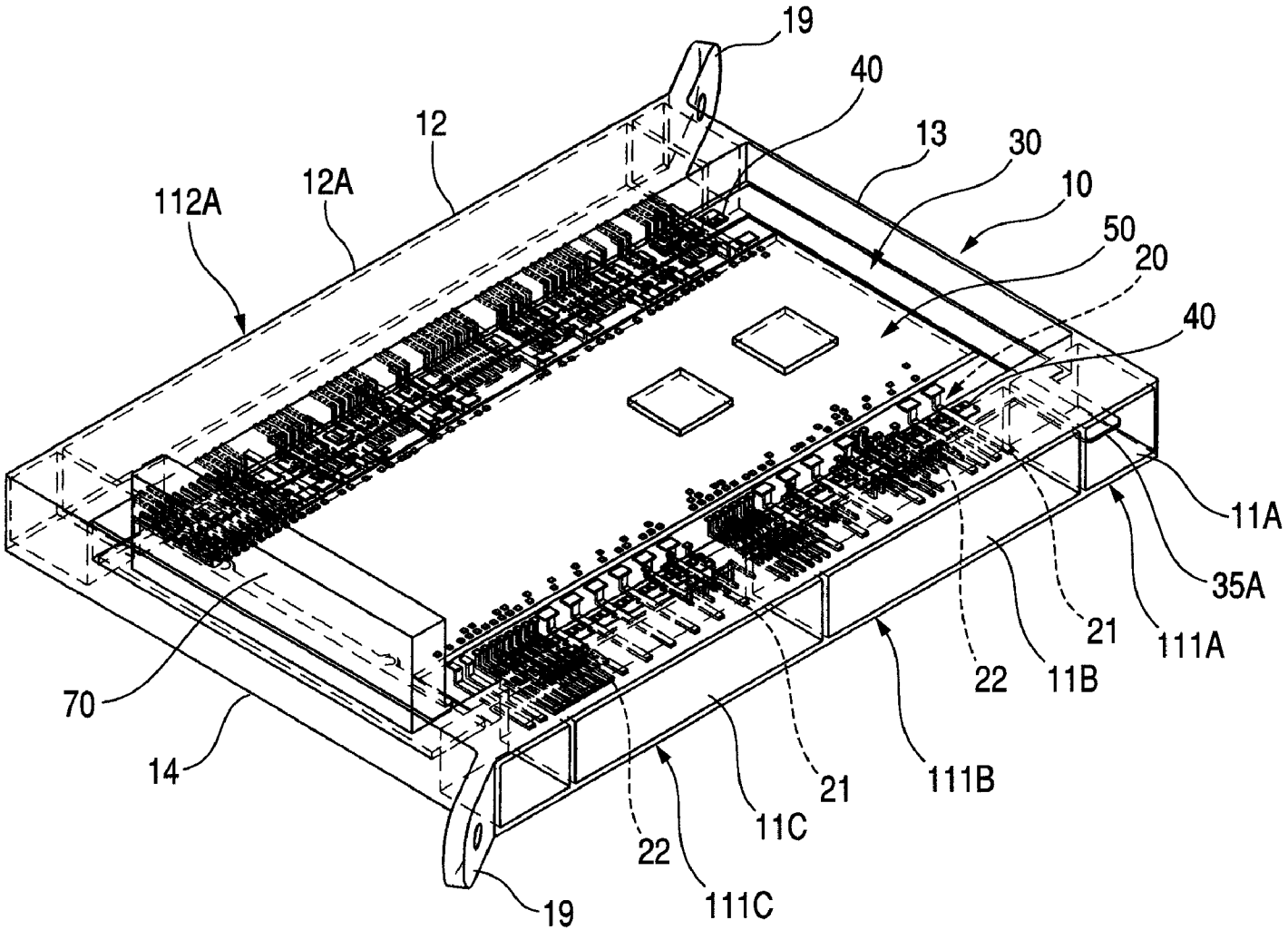
FIG. 4 is a perspective view showing a condition in which a circuit board is mounted within the housing member of FIG. 2.
Figure 5B:
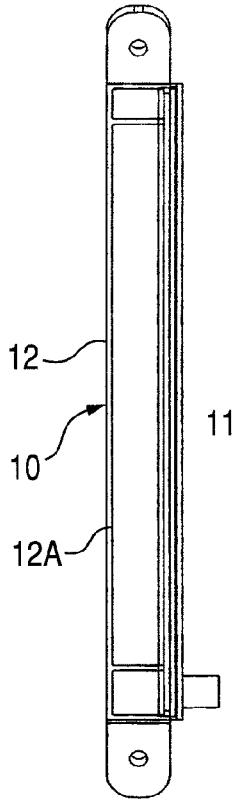
FIGS. 5B and 5C are side-elevational views in which the showing of the terminals is omitted.
Figure 5A:
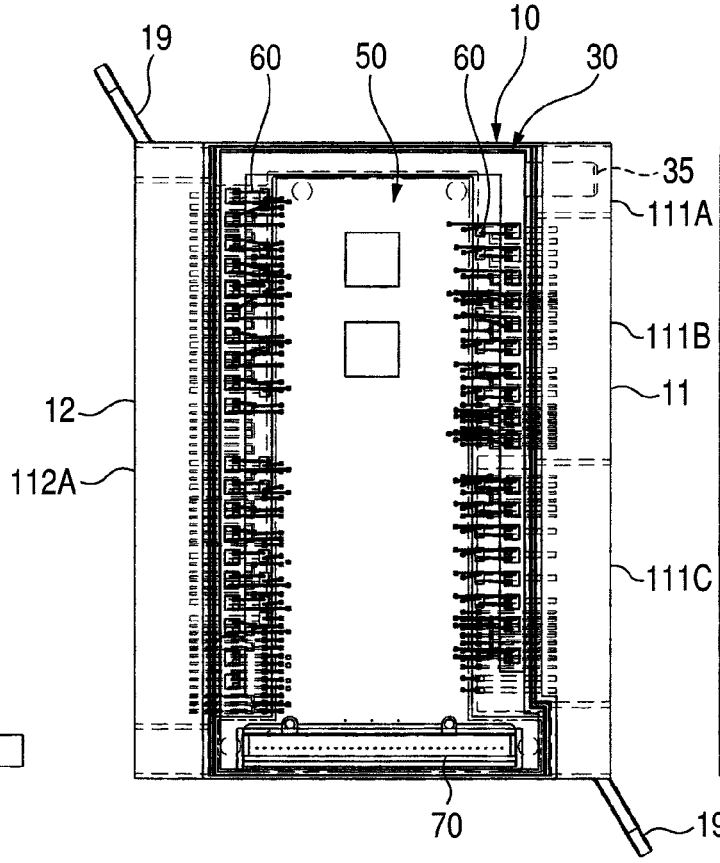
FIG. 5A is a plan view of the completed electric connection box subjected to wire bonding.
Figure 5C:
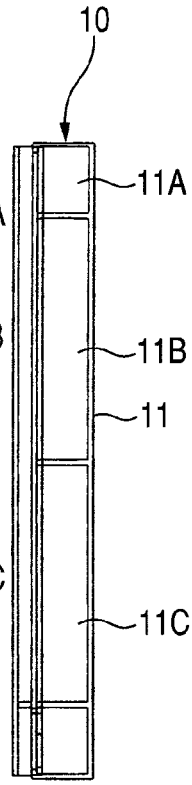
Figure 5D:
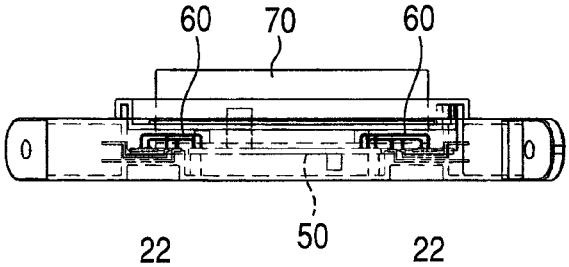
FIG. 5D is a side-elevational view as seen from such a direction that the condition of the wire bonding can be grasped.
Figure 5E:
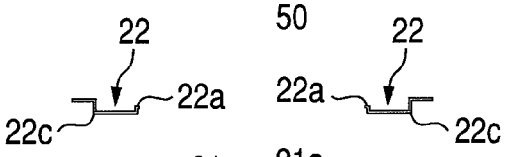
FIG. 5E is a side-elevational view showing first-type external connection terminals.
Figure 5F:
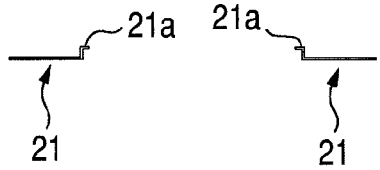
FIG. 5F is a side-elevational view showing second-type external connection terminals.
Figure 6A:
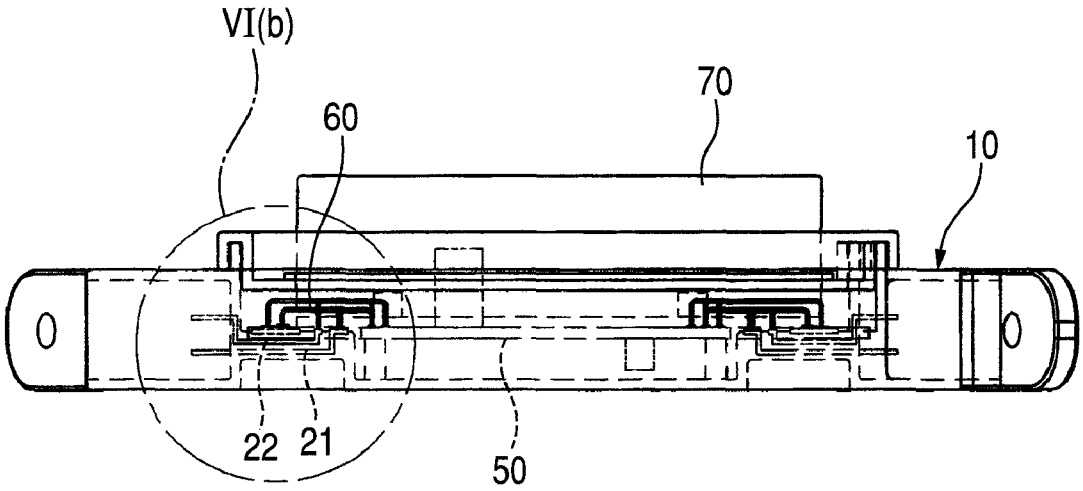
FIG. 6A is an enlarged side-elevational view of the electric connection box as seen in such a direction that the condition of the wire bonding can be grasped.
Figure 6B:
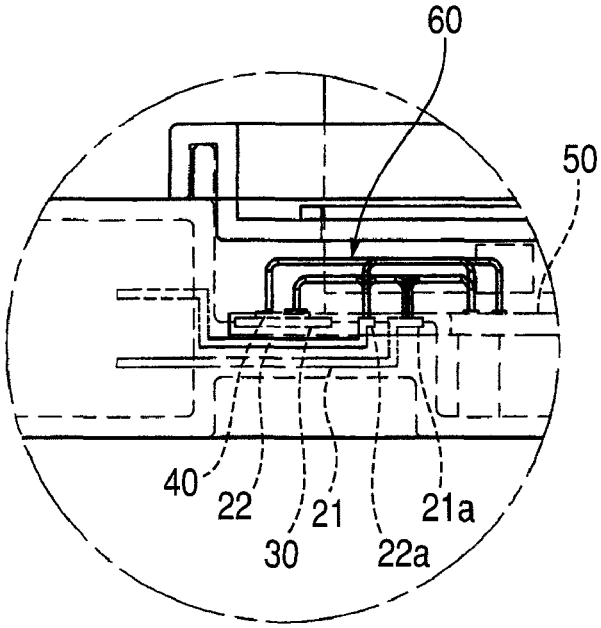
FIG. 6B is an enlarged view of a portion encircled by a broken circle VI(b) of FIG. 6A.
Figure 7:
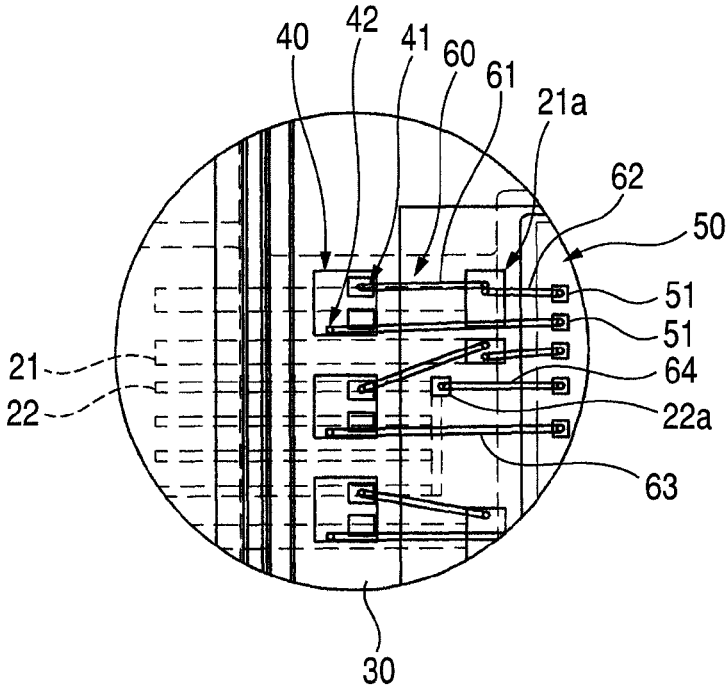
FIG. 7 is a plan view as seen from the upper side of FIG. 6B.
Figure 8:
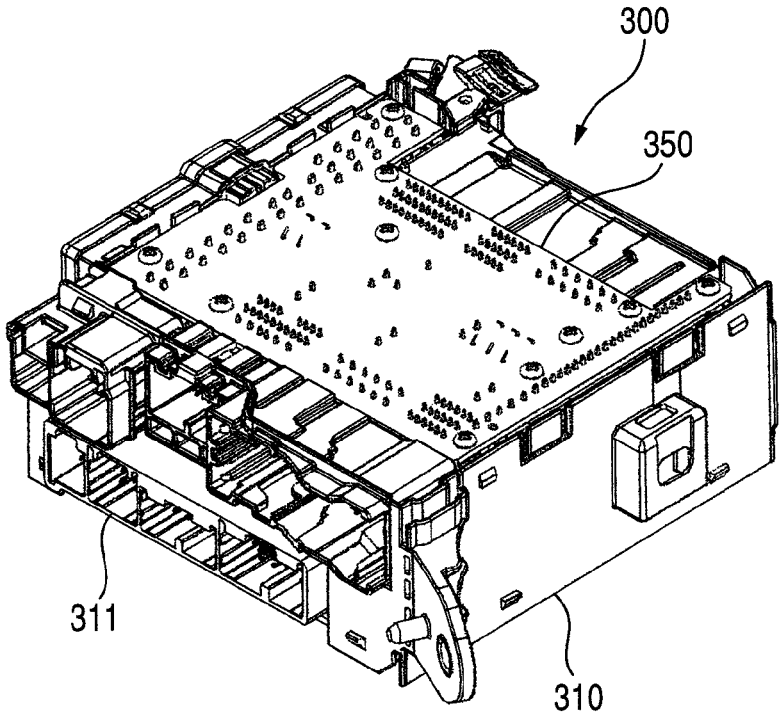
FIG. 8 is a perspective view showing the appearance of a conventional electric connection box.

FIG. 1 is an exploded perspective view of one preferred embodiment of an electric connection box of the invention, FIG. 2 is a perspective view of a housing member having external connection terminals and a lead frame which are provided integrally therewith, FIG. 3 is a plane view of the lead frame on which transistors each in a bare chip condition are surface mounted, FIG. 4 is a perspective view showing a condition in which a circuit board is mounted within the housing member of FIG. 2, FIG. 5A is a plane view of the completed electric connection box subjected to wire bonding, FIGS. 5B and 5C are side-elevational views in which the showing of the terminals is omitted, FIG. 5D is a side-elevational view as seen from such a direction that the condition of the wire bonding can be grasped, FIG. 5E is a side-elevational view showing first-type external connection terminals, FIG. 5F is a side-elevational view showing second-type external connection terminals, FIG. 6A is an enlarged side-elevational view of the electric connection box as seen in such a direction that the condition of the wire bonding can be grasped, FIG. 6B is an enlarged view .of a portion encircled by a broken circle VI(b) of FIG. 6A, and FIG. 7 is a plan view as seen from the upper side of FIG. 6B. For the better understanding of the internal structure of the electric connection box, a transparent one is used as a resin employed in the electric connection box of this embodiment.

As shown in FIG. 1, this electric connection box comprises the housing member 10 including a housing member body 10A (made of an insulative synthetic resin) having connector housing portions 11A, 11B, 11C and 12A formed integrally at an outer peripheral portion thereof, the plurality of external connection terminals 20 and the power supply lead frame 30 (having a U-shape when viewed from the top) integrally held in the receiving member body 10A of the receiving member 10, the plurality of transistors 40 in the bare chip condition which are mounted and arranged on an upper surface of the lead frame 30, the circuit board 50 mounted in a space within the receiving member 10, bonding wires 60 connecting the transistors 40, the external connection terminals 20 and the circuit board 50 to each other, a board connector 70 for connecting the circuit board 50 to a circuit board (e.g. a circuit board of an electric connection box stacked on the electric connection box of FIG. 1) of another electric connection box, and an upper cover 80 attached onto the housing member 10 to cover the lead frame 30, the transistors 40, the bonding wires 60, the circuit board 50, etc.

The lead frame 30 is formed into a one-piece flat plate-like construction, using an electrically-conductive metal sheet, and this lead frame 30 includes a first plate portion 31, a second plate portion 32 parallel to the first plate portion 31, and an interconnecting plate portion 33 interconnecting the first and second plate portions 31 and 33 at one ends thereof. A power input terminal portion 35 is formed at that end portion of the first plate portion 31 disposed close to the interconnecting plate portion 33.

An outer end portion of each external connection terminal 20 serves as a connector terminal portion, while an inner end portion thereof serves as a bonding wire connection portion. The external connection terminals 20 are classified into two kinds, that is, first-type external connection terminals 21

(whose connector terminal portions are disposed in lower portions (lower half portions) of the connector housings 11B, 11*c* and 12A) and second-type external connection terminals 22 whose connector terminal portions are disposed in upper portions (upper half portions) of the connector housings 11B, 11C and 12A. As shown in FIG. 6B, each external connection terminal 21 has the flat plate-like bonding wire connection portion 21*a* of a small area at its inner end portion, and each external connection terminal 22 has the flat plate-like bonding wire connection portion 22*a* of a small area at its inner end portion.

The housing member 10 includes the housing member body 10A, and this housing member body 10A includes a pair of parallel long side portions 11 and 12, a short side portion 13 extending between and interconnecting opposed one ends of the long side portions 11 and 12, another short side portion 14 extending between and interconnecting the (opposed) other ends of the long side portions 11 and 12, and a bottom wall 10B defining a bottom of a receiving space within a square frame-like portion defined by the long side portions 11 and 12 and the short side portions 13 and 14. The connector housing portions 11A, 11B and 11C which are open in a horizontal direction are formed at the outer side edge portion of the long side portion 11, and also the connector housing portion 12A which is open in the horizontal direction is formed at the outer side edge portion of the long side portion 12. Reference numeral 19 denotes a mounting bracket.

In the manufacture of the housing member 10, the lead frame 30 and the external connection terminals 20 (21 and 22) are set in a mold, and then an insulative synthetic resin is poured into this mold, thereby forming or molding the housing member body 10A in which the lead frame 30 and the external connection terminals 20 (21 and 22) are insert molded. As a result, the upper surface of the lead frame 30 and the bonding wire connection portions 21*a* and 22*a* of the external connection terminals 20 (21 and 22) are exposed in the space within the housing member 10, and also the power input terminal portion 35 of the lead frame 30 and the connector terminal portions of the external connection terminals 20 (21 and 22) project into the connector housing portions 11A, 11B, 11C and 12A. The connector terminal portions of the power input terminal portion 35 and external connection terminals 20 (21 and 22) are thus disposed within the connector housing portions 11A, 11B, 11C and 12A, so that connectors 111A, 111B, 111C and 112A are formed. The connector 111A is electrically connected to a plus terminal of a battery, and the other connectors 111B, 111C and 112A are electrically connected to electric loads.

As shown in FIG. 7, each of the plurality of transistors 40 in the bare chip condition comprises a power MOSFET having an input terminal pad portion (D: drain pad) (not shown) at its lower surface and also having an output terminal pad portion (S: source pad) 41 and a control terminal pad portion (G: gate pad) 42 at its upper surface. These transistors 40 are arranged and mounted in a row on the first and second plate portions 31 and 32, with their input terminal pad portions (formed at the lower surfaces thereof) directly soldered to the upper surface of the lead frame 30. In this case, when silver paste having a low melting point is used as a bonding material, the transistors 40 can be surface mounted on the lead frame 30 by inserting them, together with the receiving member 10, into a furnace.

The circuit board 50 is a printed wiring board of a rectangular shape having electronic parts 52 mounted on its one side or its both sides, and this circuit board 50 has lands 51 of circuit patterns formed near to long side edge portions thereof.

As shown in FIGS. 6A, 6B and 7, the output terminal pad portions 41 formed respectively on the upper surfaces of the transistors 40 are connected to the bonding wire connection portions 21*a* and 22*a* of the external connection terminals 20 (21 and 22) by first bonding wires 61, and the control terminal pad portions 42 formed respectively on the upper surfaces of the transistors 40 are connected to the lands of the signal control circuit pattern on the circuit board 50 by second bonding wires 63. In order to monitor a voltage of the output terminal pad portions 41 of the transistors 40, the bonding wire connection portions 21*a* of the external connection terminals 21 connected to the output terminal pad portions 41 are connected to the lands of the voltage-monitoring circuit pattern on the circuit board 50 by third bonding wires 62.

In this embodiment, the bonding wire connection portions 21*a* and 22*a* of the external connection terminals 20 (21 and 22) are disposed in a floating island fashion between the lead frame 30 and the circuit board 50, and are directed upwardly, and the upper surfaces of the bonding wire connection portions 21*a* and 22*a* of the external connection terminals 20, the upper surfaces of the output terminal pad portions 41 and control terminal pad portions 42 formed on the upper surfaces of the transistors 40, and the upper surfaces of the lands of the circuit patterns of the circuit board 50 are disposed generally at the same height.

Furthermore, the connector terminal portions of the external connection 255 terminals 20 (21 and 22) disposed in each of the connector housing portions 11B, 11C and 12A are arranged in two rows (upper and lower rows) in the upward-downward direction (vertical direction), and therefore by forming a bent portion 22*c* of an L-shape at an intermediate portion of each upper-row external connection terminal 22 as shown in FIGS. 5E, 5F, 6A and 6B, the upper surfaces of the bonding wire connection portions 21*a* and 22*a* of the external connection terminals 21 and 22 are disposed generally at the same height.

Next, a process of producing the electric connection box will be briefly described.

For producing this electric connection box, first, the lead frame 30 and the external connection terminals 20 (21 and 22) are set in the mold, and then the housing member 10 as shown in FIG. 2 is injection molded. Then, the transistors 40 are surface mounted on the upper surface of the lead frame 30 as shown in FIG. 3. Then, the circuit board 50 is located in the space within the receiving member 10 as shown in FIG. 4, and then the process proceeds to the wire bonding step. In this wire bonding step, the transistors 40, the external connection terminals 20 and the circuit board 50 are connected to each other by the bonding wires 61, 63 and 62 as shown in FIGS. 5A to 7. Then, the upper cover 80 is attached to the housing member 10, thus completing the electric connection box of this embodiment.

Next, advantageous effects of the electric connection box of this embodiment will be described.

In this electric connection box, any circuit pattern for power supply purposes is eliminated from the circuit board 50, and power supply is entirely effected via the lead frame 30 provided separately from the circuit board 50. Therefore, only the circuit pattern for signals need to be formed on the circuit board 50, and a compact and lightweight design of the circuit board 50 can be achieved. In addition, the cross-sectional dimensions of the lead frame 30 are not so limited as compared with circuit patterns formed on the circuit board 50, and can be freely determined, and therefore a heat radiation performance against heat generated by energization can be enhanced.

Furthermore, heat generated at the transistors 40 in the bare chip condition is radiated directly via the lead frame 30 without being transferred to the circuit board 50, and therefore the excellent heat radiation effect can be obtained. Furthermore, the transistors 40 are used instead of mechanical relays, and besides the connector 111A for power inputting purposes and the connectors 111B, 111C and 112A for electric load-connecting purposes are provided at the outer peripheral portion of the electric connection box, and further the circuit board 50 is accommodated in the space within the housing member 10. Therefore, particularly the thin design of the electric connection box can be achieved. Furthermore, the housing member 10 is formed such that not only the external connection terminals 20 but also the lead frame 30 are insert molded in the housing member body 10*a*. Therefore, the lead frame 30 does not need to be mounted on the housing member 10 at a later stage, so that the efficiency of the assembling operation is enhanced.

Furthermore, the bonding wire connection portions 21*a* and 22*a* of the external connection terminals 20 (21 and 22) are disposed in a floating island fashion between the lead frame 30 and the circuit board 50, and are directed upwardly, and therefore the bonding operation for connecting the transistors 40, the external connection terminals 20 and the circuit board 50 to each other can be effected easily. Furthermore, the distance between the lead frame 30 and the circuit board 50 increases, and therefore heat is less liable to be transferred from the lead frame 30 to the circuit board 50, and besides a space is formed between the lead frame 30 and the circuit board 50, so that the heat radiating performance of the lead frame 30 is enhanced.

In order to monitor the voltage of the output terminal pad portion 41 of the transistor 40, the bonding wire connection portion 21*a* of the external connection terminal 21 is connected to the circuit board 50 by the third bonding wire 62, and therefore when eddy current develops, a control for turning off the transistor 40 can be possible, thus achieving the function of a fuse.

Furthermore, in the electric connection box of this embodiment, the upper surfaces of the bonding wire connection portions 21*a* and 22*a* of the external connection terminals 20 (21 and 22), the upper surfaces of the output terminal pad portions 41 and control terminal pad portions 42 formed on the upper surfaces of the transistors 40, and the upper surfaces of the circuit patterns of the circuit board 50 are disposed generally at the same height. Therefore, the external connection terminals 20, the transistors 40 and the circuit board 50 can be connected to each other with one bonding step. Furthermore, the fact that these upper surfaces are disposed generally at the same height also contributes to the thin design of the electric connection box.

Furthermore, even when the external connection terminals 20 (21 and 22) are arranged in two or more rows in the connector housing portions 11B, 11C and 12A, the bonding wire connection portions 21*a* and 22*a* of the external connection terminals 20 are disposed generally at the same height, and therefore the compact design of the electric connection box and the simplified bonding step can be achieved while increasing the number of poles of the connectors 111A, 111B and 121A.

The present invention is not limited to the above embodiment, and suitable modifications, improvements, etc., can be made. Furthermore, the material, shape, dimensions, number, disposition, etc., of each of the constituent elements of the above embodiment are arbitrary, and are not limited in so far as the invention can be achieved.

The transistors 40 are not limited to the MOSFETs, and may be bipolar transistors.

What is claimed is:

1. An electric connection box comprising:

a metal lead frame to which a power is supplied;

an external connection terminal having a wire connector portion;

a circuit board separately provided from the lead frame and separated from the lead frame;

a transistor mounted on the lead frame;

a first bonding wire connecting the transistor and the wire connector portion;

a second bonding wire connecting the transistor and the circuit board; and a housing member accommodating the lead frame, the external connection terminal, and the circuit board.

2. The electric connection box according to claim 1, wherein the wire connector portion of the external connection terminal is arranged in a floating island fashion between the lead frame and the circuit board.

3. The electric connection box according to claim 1, wherein the housing member is molded of an insulative synthetic resin.

4. The electric connection box according to claim 1, wherein the transistor is mounted on the lead frame in bare chip condition.

5. The electric connection box according to claim 1, further comprising a third bonding wire connecting the transistor and the circuit board for monitoring the output voltage of the transistor.

6. The electric connection box according to claim 1, wherein the external connection terminal and the lead frame are insert molded in the housing member.

7. The electric connection box according to claim 1, wherein the lead frame is flat plate shaped.

8. The electric connection box according to claim 1, wherein the wire connector portion is directed perpendicular to a surface of the circuit board.

9. The electric connection box according to claim 1, wherein the external connection terminals further having a connector terminal portion which is arranged on a periphery of the housing member.

* * * * *